US005499618A

United States Patent [19]

Thompson

[11] Patent Number: 5,499,618

[45] Date of Patent: Mar. 19, 1996

[54] LEVER ACTION ARCHERY BOW

[76] Inventor: George E. Thompson, 19088 Hess Ave., Sonora, Calif. 95370

[21] Appl. No.: 309,071

[22] Filed: Sep. 20, 1994

[51] Int. Cl.[6] ..... F41B 5/10

[52] U.S. Cl. ..... 124/25.6; 124/88

[58] Field of Search ..... 124/23.1, 24.1, 124/25.6, 86, 88, 900

[56] References Cited

U.S. PATENT DOCUMENTS

| | | | |
|---|---|---|---|
| 3,486,495 | 12/1969 | Allen | 124/25.6 |
| 3,851,638 | 12/1974 | Alexander | 124/25.6 |
| 3,967,609 | 7/1976 | Frydenlund | 124/25.6 |
| 3,989,026 | 11/1976 | Nishioka | 124/25.6 |
| 4,287,867 | 9/1981 | Islas | 124/25.6 |
| 4,368,718 | 1/1983 | Simonds et al. | 124/25.6 |
| 4,512,326 | 4/1985 | Jarrett | 124/25.6 |
| 4,646,708 | 3/1987 | Imes | 124/23.1 |
| 4,667,649 | 5/1987 | Humphrey | 124/25.6 |
| 4,672,943 | 6/1987 | Bozek | 124/25.6 |
| 4,683,865 | 8/1987 | Troncoso | 124/25.6 |
| 4,858,588 | 8/1989 | Bozek | 124/23.1 |
| 4,955,354 | 9/1990 | Bozek | 124/23.1 |
| 5,024,206 | 6/1991 | Lester | 124/23.1 |
| 5,150,699 | 9/1992 | Boissevain | 124/25.6 |
| 5,388,564 | 2/1995 | Islas | 124/25.6 |
| 5,408,982 | 4/1995 | Doornenbal | 124/23.1 |

*Primary Examiner*—John A. Ricci
*Attorney, Agent, or Firm*—Schapp and Hatch

[57] ABSTRACT

A lever action archery bow is disclosed which includes a central riser and a pair of working limbs attached to each end of the central riser. A rocking recurve lever is pivotably mounted at the outer end of each limb, and the bowstring is secured to the outer ends of the recurve levers in the conventional manner. Each recurve lever is a lever of the first class the fulcrum of which is mounted adjacent the outer end of its associated limb, and anchors for draw force transfer cables are pivotably attached to each recurve lever at its end remote from the end thereof to which the bow string is attached. The invention includes embodiments in which the recurve levers are rigid, and embodiments in which the recurve levers are resilient working members.

9 Claims, 7 Drawing Sheets

LEVER ACTION ARCHERY BOW

BACKGROUND OF THE INVENTION

1. Field of the Invention

My present invention relates to archery bows, and more particularly to cross-coupled archery bows, i.e., archery bows comprising cross-coupling or draw force transfer cables by means of which draw forces are transferred between opposing limbs.

2. Description of the Prior Art

Cross-coupled archery bows are well known in the prior art.

Holless W. Allen U.S. Pat. No. 3,486,495, issued on Dec. 30, 1969, discloses archery bows with draw force multiplying attachments. More particularly, Allen discloses archery bows having rotatable, variable leverage pulley members on the tips of the bow limbs. A cross-coupling cable is wound around the pulley members to provide mechanical advantage, and less force is required to pull the bow string in a fully drawn position than to hold the bow string at an intermediate draw position.

Arthur J. Frydenlund U.S. Pat. No. 3,967,609, issued on Jul. 6, 1976, discloses a cross-coupled archery bow which is provided with a concentric sheave at each of the bow limb tips, and has a pivotable lever with a pulley mounted at each end of the bow handle. The levers are connected via a continuous stretch reeved over each lever and extending toward the most remote sheaves on the bow limbs and then to the ends of the bow string. A tensioning cable of fixed length is connected between each lever and its respective nearby or adjacent sheave. As the bow string is drawn the draw force will vary due to the pivoting of the levers. When the levers pass over dead center the tension cable will engage a member on each lever and limit the maximum draw of the bow string.

Jim Zenji Nishioka U.S. Pat. No. 3,989,026, issued on Nov. 2, 1976, discloses an archery bow with balanced adjustable tension having a pair of oppositely extending bow arms on a main body portion having guides on their tips. A bow string extension between the tips has end sections movably contacting the guides. The bow has a drawing force produced either by flexible bow arms or a resilient member on the bow, and a second guide is employed to receive the end sections of the bow string and position them so that they will be acted upon equally by the drawing force while moving in unison with it to provide a balanced bow for accurate shooting of arrows.

Gary Simonds and Arnold D. McKee U.S. Pat. No. 4,368,718, issued on Jan. 18, 1993, discloses a compound bow having an eccentric cam member pivotably mounted on each bow limb tip, each cam including an outwardly projecting hook or lever section; the ends of said bowstring being wrapped around said cams.

David W. Jarrett U.S. Pat. No. 4,512,326, issued on Apr. 23, 1985, discloses an archery bow including oppositely extending rigid limbs each rotatably supporting lever mechanisms. A pair of flexible limbs are secured to the bow overlying the respective rigid limbs. A bow string is connected to each of the lever mechanisms. Also a separate force cable is connected between each terminal end of the flexible limbs and respective lever mechanisms. The lever mechanisms each are provided with a stop limiting rotation thereby preventing an over-center condition. The lever mechanisms include pulleys receiving a synchronizing cable evenly distributing pull forces on the bow string to the ends of the rigid limbs. The bow string connections, the force cable connections and the lever mechanism pivot points are placed to provide a second class lever mechanical advantage. Rotation of the lever mechanisms to place the cable connecting points and the lever mechanisms pivot points in a near straight position reduces the shooting-hold force to near zero. The magnitude of the shooting-hold force is variably regulated by adjustment of the stop.

These prior art cross-coupled archery bows are characterized by one or more of the following disadvantages: mechanical complexity, heavy bow weight, lack of full adjustability, friction drag due to the utilization of pulleys which rotate through large angles, i.e., angles approaching 90° or more, reaction against the hands of the archer due to abrupt movement of the bow resulting from abrupt acceleration or halting of moving parts, unadjustable imbalance between the upper and lower halves of the bow resulting in non-linear arrow flight, etc.

It is believed that the United States patents listed immediately below contain information which is or might be construed to be material of the examination hereof.

U.S. Pat. No. 3,851,638

U.S. Pat. No. 4,667,649

U.S. Pat. No. 4,672,943

U.S. Pat. No. 4,683,865

A copy of each of the above-cited United States patents was supplied to the United States Patent and Trademark Office at the time of filing.

No representation or admission is made that any of the above-cited United States patents is part of the prior art, or that a search has been made, or that no more pertinent information exists.

The term "prior art" as used herein or in any statement made by or on behalf of applicant means only that any document or thing referred to as prior art bears, directly or inferentially, a date which is earlier than the effective filing date hereof.

SUMMARY OF THE INVENTION

Accordingly, it is an object of my present invention to provide cross-coupled archery bows which are devoid of cams and pulleys and their attendant friction, and which thus are characterized by faster bow string recovery than is found in prior art cross-coupled archery bows.

Another object of my present invention is to provide cross-coupled archery bows which do not have extended portions of their cables wrapped around cams or pulleys, thus eliminating friction which, in cross-coupled archery bows of the prior art, opposes or damps the action of the cross-coupling cables, and thus reduces the cast and penetration of arrows launched therefrom.

It is yet another object of my present invention to provide cross-coupled archery bows in which the cross-coupling cables remain in a straight line at all times, thus completely eliminating friction in the cross-coupling action and consequently increasing bow string recovery time and reducing the peak drawing force for bows of a given impact energy.

A further object of my present invention is to provide cross-coupled archery bows having inner limbs and outer limbs, the outer limbs being pivotably joined to the inner limbs.

A yet further object of my present invention is to provide cross-coupled archery bows in which said outer limbs are of outwardly concave recurve configuration, whereby the bow string is permitted to move outwardly and forwardly at the same time, and thus the bow string can move its associated arrow at a much faster delivery rate than a string which moves only in the forward direction, while being wrapped around a cam, thus providing an action which is much faster than that provided by a rotary cam.

Another object of my present invention is to provide cross-coupled archery bows having inner or main limbs and outer or recurve limbs, wherein only the outer ends of the inner limbs move during the drawing of the bow, and that movement is less than 1.5 inches in length at draw length of up to 33 inches, providing a very significant safety factor, as the Allen compound bow limbs move over four inches at 33 inch draw length.

It is yet another object of my present invention to provide cross-coupled archery bows in which the pulling weight or draw force is totally and independently adjustable.

It is a further object of my present invention to provide cross-coupled archery bows in which the balance or limb synchronization is totally and independently adjustable.

It is a yet further object of my present invention to provide cross-coupled archery bows in which the draw length is totally and independently adjustable.

It is another object of my present invention to provide cross-coupled archery bows in which the draw force, draw length and balance or limb synchronization are independently adjustable in the field.

It is yet another object of my present invention to provide cross-coupled archery bows in which the draw length is proprioceptively defined by bow string reaction, and is adjustable.

A further object of my present invention is to provide cross-coupled archery bows in which balance or limb synchronization can be attained by independent adjustment means, and thus the trajectory of the arrow can be highly linearized to great arrow flight distances.

A yet further object of my present invention is to provide cross-coupled archery bows characterized by true lever action across a fulcrum point.

Another object of my present invention is to provide cross-coupled archery bows including levers of the first class in which the bow string and a cross-coupling cable are affixed to each lever on opposite sides of the pivot.

Yet another object of my present invention is to provide cross-coupled archery bows having levers pivotably mounted at or near the outer end of each main limb, which levers rock through an angle of less than 90° during the launching of an arrow, which small rocking angle results in high energetic efficiency of the bow, high cast of the arrow, and high arrow impact energy.

A further object of my present invention is to provide cross-coupled archery bows which achieve at least one of the above objects and at the same time are very light in weight.

Other objects of my present invention will in part be obvious and will in part appear hereinafter.

My present invention, accordingly, comprises apparatus embodying features of construction, combinations of elements, and arrangements of parts which are adapted to affect such steps, and the several steps of bow adjustment, and arrangements of parts which are adapted to affect such bow adjustment steps, all as exemplified in the following disclosure, and the scope of the present invention will be indicated in the claims appended hereto.

In accordance with a principal feature of my present invention cross-coupled archery bows thereof are provided with inner limbs and outer limbs.

In accordance with another principal feature of my present invention said outer limbs are of outwardly concave or recurve configuration.

In accordance with yet another principal feature of my present invention said outer or recurve limbs are resilient working elements.

In accordance with a further principal feature of my present invention said outer limbs are substantially rigid lever elements.

In accordance with another principal feature of my present invention said outer limbs are levers of the first class.

In accordance with another principal feature of my present invention each of said outer limbs is mounted on its associated inner limb by pivot means which is attached to said outer limb at a point located between the outer end of said outer limb and the inner end of said outer limb.

In accordance with a yet further principal feature of my present invention said pivot means is attached to each outer limb between the attachment points of the bow string and one of the cross-coupling cables.

In accordance with a further principal feature of my present invention each cross-coupling cable extends linearly between the outer end of one inner limb and a yoke which embraces the outer end of the other inner limb and is pivotably attached to the outer end of the associated outer limb.

In accordance with a yet further principal feature of my present invention each coupling cable is affixed to its associated outer limb by selective mounting means whereby the end of said yoke adjacent the outer end of the associated outer limb can be selectively positioned at different distances from the outer end of that outer limb.

In accordance with another principal feature of my present invention said inner limbs are pivotably attached to opposite ends of the riser and adjustable coupling means are provided whereby the angle between the riser and the inner ends of the inner limbs may be adjusted at will.

In accordance with a further principal feature of my present invention adjustment means are provided whereby the length of each cross-coupling cable extending from its associated yoke to its opposite end may be selectively adjusted.

For a fuller understanding of the nature and objects of the present invention, reference should be had to the following detailed description, taken in connection with the accompanying drawings.

DESCRIPTION OF THE PREFERRED EMBODIMENTS

Figure 1:
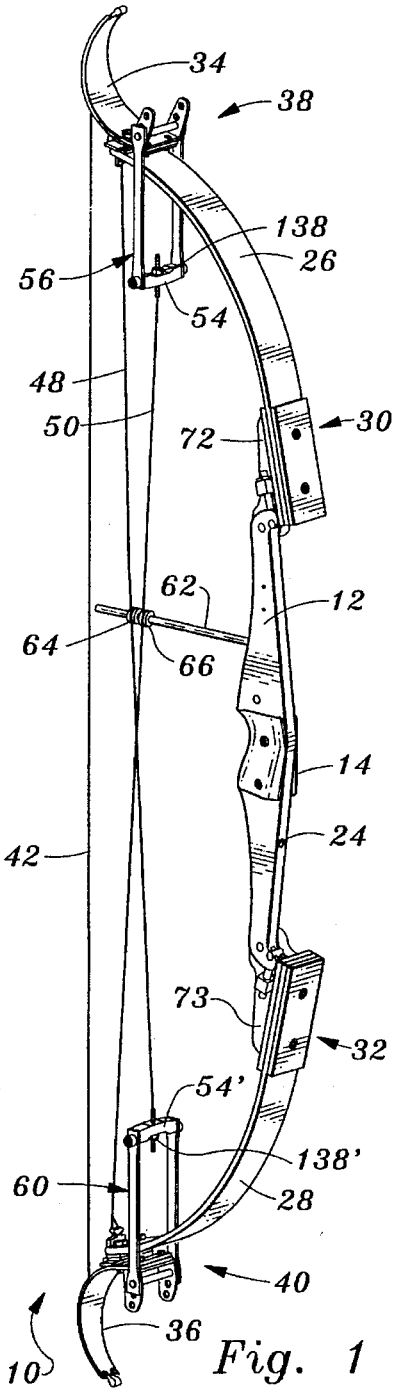
FIG. 1 is a perspective view of an archery bow of the first preferred embodiment of my present invention, adjusted for immediate use, with the bowstring undrawn.

Referring now to FIG. 1 there is shown an archery bow 10 constructed in accordance with the first preferred embodiment of my present invention.

Archery bow 10 of the first preferred embodiment is comprised of an elongated central rigid body member 12 of the kind sometimes called a "riser" in the prior art.

As also seen in FIG. 1, riser 12 is provided with a handle or grip 14 which is so contoured as to permit the archer to comfortably and correctly grip riser 12 with one hand.

Figure 14:
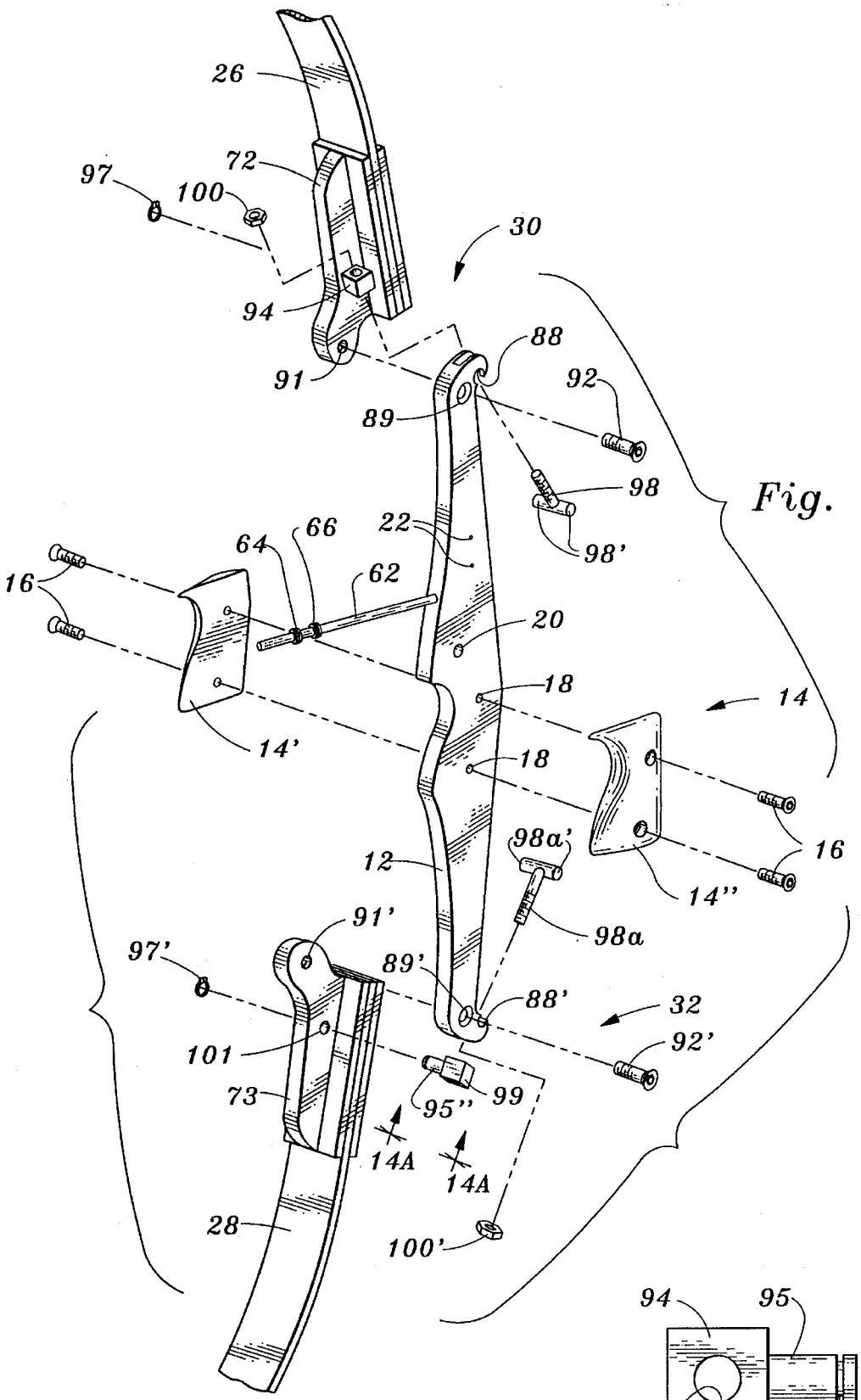
FIG. 14 is an exploded partial perspective view of the central portion of the archery bow of the first preferred embodiment of my present invention, showing the central portion thereof.

As best seen in FIG. 14, grip 14 is comprised of two parts 14', 14" which are fastened to the opposite sides of riser 12 by means of suitable screws 16 the inner ends of the threaded shanks of which are engaged with the internal threads of tapped holes 18 in riser 12.

Grip members 14', 14" are preferably formed from wood of the kind used in fabricating rifle stocks.

Riser 12 is preferably cut from metal plate, such as a plate of 6061-T6 aluminum alloy.

As also seen in FIG. 14, riser 12 is provided with suitable tapped holes 20, 22 whereby to attach thereto suitable archery bow attachments of well known kind, such as an arrow rest, an aiming sight, a bow quiver or a stabilizing rod.

Another tapped hole 24 for mounting a suitable attachment on riser 12 is shown in FIG. 1.

Also shown in FIG. 1 are the upper inner limb 26 and the lower inner limb 28 of bow 10 of the first preferred embodiment.

Inner limbs 26 and 28 are draw force energy storage elements or "working" elements, and thus are preferably laminated in the well known manner.

In the first preferred embodiment each inner limb 26, 28 is fabricated from three laminae, the inner lamina being fabricated from maple or a fiberglass or carbon fiber-epoxy composite material and the two outer laminae being fabricated from a fiberglass or carbon fiber-epoxy composite material.

Said laminae are preferably bonded together by means of a suitable epoxy cement, and in a particularly preferred embodiment each limb 26,28 may be fabricated from as many as seven laminae. Recurve levers 34, 36 may be fabricated from the same or similar laminated material.

Referring again to FIG. 1, it will be seen that upper inner limb 26 is joined to the upper end of elongated body member 12 by means of an upper limb joint 30 (including wing 72), and that lower inner limb 28 is joined to the lower end of elongated body member 12 by means of a lower limb joint 32 (including wing 73).

Upper limb joint 30 is shown in perspective in FIG. 5, and its construction and operation are explained in connection with FIGS. 5, 6, 7, 14 and 14A.

Referring again to FIG. 1, it will be seen that an upper recurve lever or outer limb 34 is mounted on the upper (outer) end of upper inner limb 26, and that a lower recurve lever or outer limb 36 is mounted on the lower (outer) end of lower inner limb 28.

In the first preferred embodiment of my invention both upper recurve lever 34 and lower recurve lever 36 are draw force energy storage elements or working elements, and thus are laminated in the well known manner.

It is to be understood that the term "working" as used herein refers in general to resilient elements which are deformed to store arrow launching energy when a bowstring is drawn, and is not limited to laminated elements,or to laminated elements having a particular number of laminae, or being fabricated from particular materials.

It is also to be understood that my invention includes a third preferred embodiment in which the recurve levers are rigid, rather than resilient.

Figure 2:
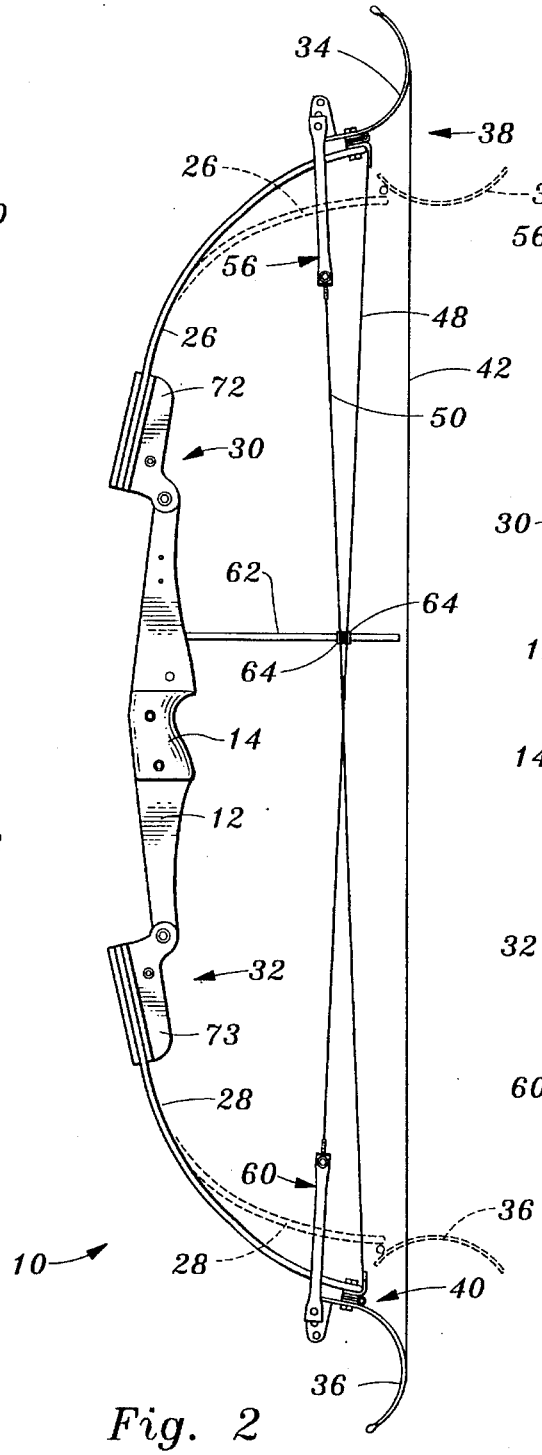
FIG. 2 is an elevational view of the left-hand side of the archery bow of the first preferred embodiment of my present invention, as shown in FIG. 1.
Figure 4:
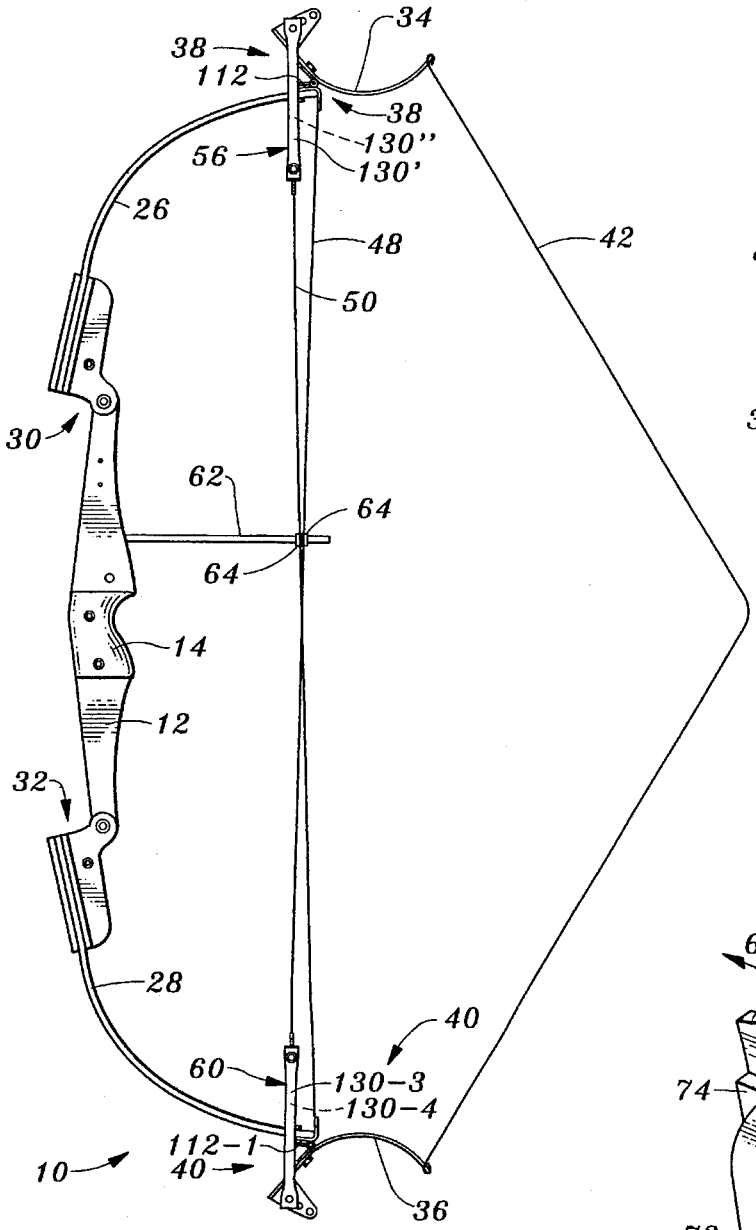
FIG. 4 is an elevational view of the left-hand side of the archery bow of the first preferred embodiment of my present invention, with the bowstring fully drawn.

As may best be seen by comparison of FIGS. 2 and 4, upper outer limb 34 is pivotably mounted on upper inner limb 26 by means of an upper outer limb pivot assembly 38, and lower outer limb 36 is pivotably mounted on lower inner limb 28 by means of a lower outer limb pivot assembly 40.

Referring again to FIG. 1, it will be seen that bowstring 42 extends from upper recurve lever 34 to lower recurve lever 36.

Figure 8:
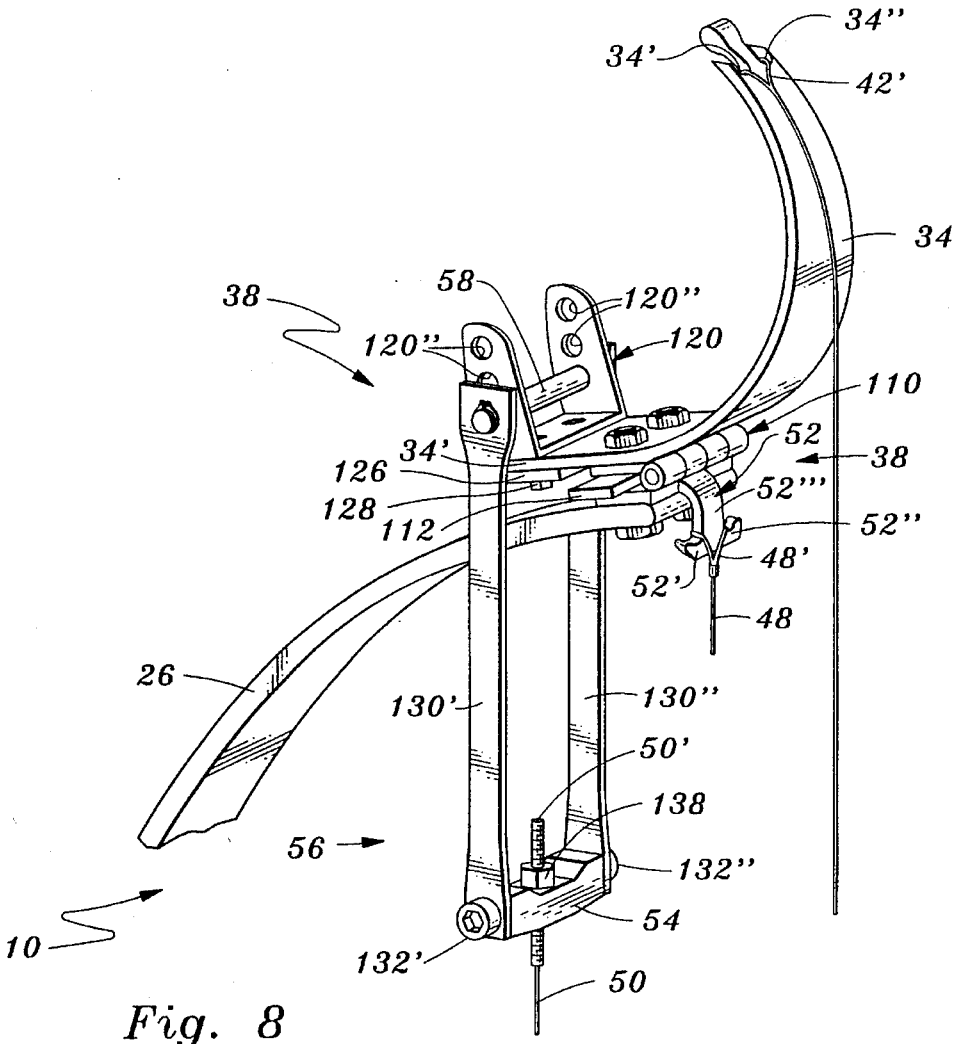
FIG. 8 is a partial perspective view of the archery bow of the first preferred embodiment of my present invention, adjusted for immediate use, with the bowstring undrawn, showing the upper end of the left-hand side thereof.

Referring now to FIG. 8, it will be seen that the upper (outer) end of upper recurve lever 34 is provided with a pair of notches 34', 34", and that the upper end of bowstring 42 is provided, in the well known manner, with a loop 42'.

It will also be seen in FIG. 8 that the upper end of bowstring 42 is secured to the outer end of upper recurve lever 34 by the engagement of loop 42' with notches 34', 34".

It will further be seen from FIG. 8 that when bowstring 42 is undrawn a portion of the outer (convex) face of upper recurve lever 34 is contacted by the upper end of bowstring 42.

By comparison of FIG. 2 with FIG. 8, it will be evident to those having ordinary skill in the archery bow art, informed by the present disclosure, that the lower end of bowstring 42 is secured to and cooperates with lower recurve lever 36 in substantially the same manner in which the upper end of bowstring 42 is secured to and cooperates with upper recurve lever 34.

Referring again to FIG. 1, it will be seen that bow 10 of the preferred embodiment of my present invention further includes a pair of draw force transfer or cross-coupling cables 48, 50.

Draw force transfer or cross-coupling cable 48 is sometimes called the "outer cable" herein because, as bow 10 is shown in the present drawings, the upper end of cable 48 is secured to upper inner limb 26 at a position located outside the adjacent end of cable 50.

By the same reasoning, cable 50 is correspondingly called the "inner cable" herein.

Referring now to FIG. 8, it will be seen that the upper end of outer cable 48 is provided with a loop 48', and that loop 48' is interengaged with a pair of ears 52', 52" which project outwardly from the shank 52"' of a cable anchor 52.

Cable anchor 52 is itself affixed, in the manner explained hereinafter, to the outer end of upper inner limb 26.

As also seen in FIG. 8, the upper end of inner cable 50 is provided with a threaded ferrule 50'. Ferrule 50' is passed through a clearance bore (140, FIG. 13) in the lower crossbar 54 of a yoke 56.

A fiber lock nut 138 is then engaged with the threads of ferrule 50', whereby bow 10 may be adjusted.

As also seen in FIG. 8, the upper crossbar 58 of yoke 56 is pivotably affixed to the inner end of upper outer limb 34.

As may be seen by comparison of FIGS. 2 and 8, the lower ends of cables 50, 48 are respectively affixed to lower inner limb 28 and to lower outer limb 36, via yoke 60, in substantially the same manner in which the upper ends of cables 48, 50 are affixed, respectively, to upper inner limb 26 and to upper outer limb 34 via yoke 56.

Figure 12A:
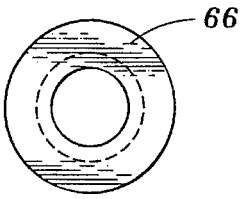
FIGS. 12A and 12B show one of the two cross-coupling cable bearings which are interposed between the respective cross-coupling cables and their associated cable deflector rod, as seen in FIG. 1.
Figure 12B:
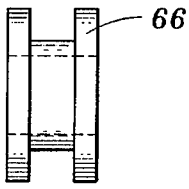

Referring again to FIG. 2, it will be seen that bow 10 is further comprised of a cable deflector rod 62, and that a pair of cable bearings 64, 66 of well known type (FIGS. 12A and 12B) are interposed between cables 48, 50, respectively, and cable deflector rod 62, in the well known manner. Bearings 64, 66 may be made from Nylon or similar material having self-lubricating properties, such that bearings 64, 66 can easily rotate about rod 62 and also easily translate thereal-ong.

The particular aspect of cable deflector rod 62 which is a feature of the present invention is shown in FIG. 14, and is described hereinbelow in connection with FIG. 14.

Referring now to FIGS. 2 and 4, and comparing the same, it will be seen that in contrast with many archery bows of the prior art, such as the bows of the above-cited Allen and Jarrett patents, the limbs 26, 28 of bow 10 are substantially curved when the bow string 42 is undrawn.

Figure 3:
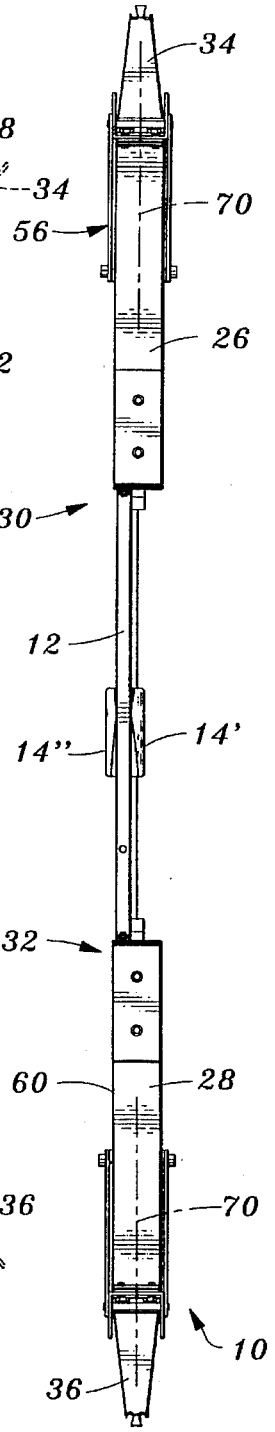
FIG. 3 is an elevational view of the front end of the archery bow of the first preferred embodiment of my present invention, as shown in FIGS. 1 and 2.

As seen in FIG. 3, riser 12 and handle 14 are offset with respect to the plane of symmetry 70 which subdivides limbs 26, 28 and recurve levers 34, 36 into substantially equal, mirror-image halves. Thus, it will be understood by those having ordinary skill in the art, informed by the present disclosure, that the bow 10 may be easily and rapidly converted from a right-hand bow to a left-hand bow, by dismounting joints 30, 32, turning riser 12 through 180° about a horizontal axis parallel to plane 70, mounting new, left-hand handles on riser 12, and then remounting limb-riser joints 30, 32.

Figure 5:
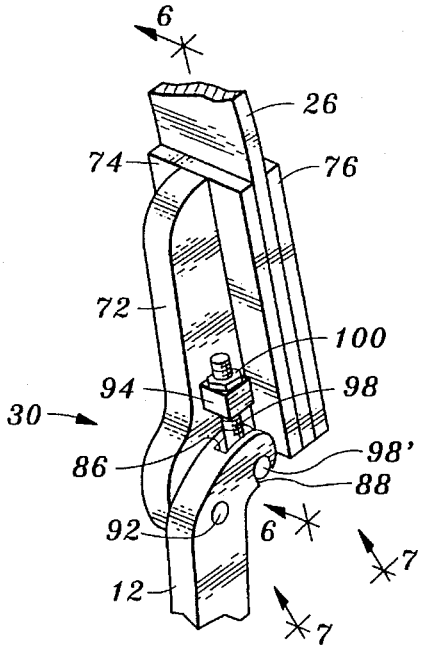
FIG. 5 is a partial perspective view of the archery bow of the first preferred embodiment of my present invention, showing the adjustable joint between the riser and the upper limb.

Referring now to FIG. 5, there is shown adjustable limb-riser joint 30 and its relationship to upper inner limb 26 and the upper end of riser 12.

Figure 6:
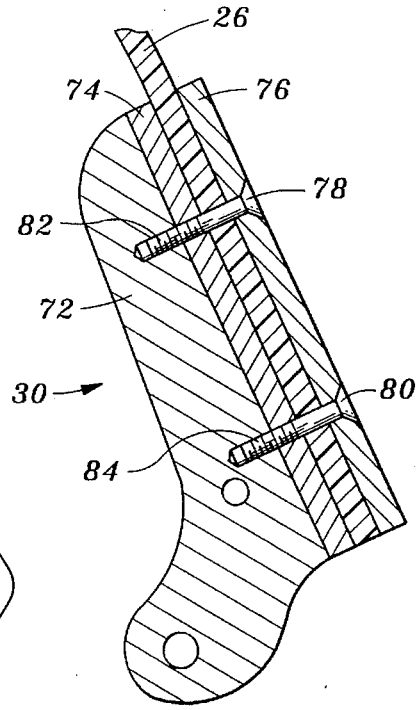
FIG. 6 is a partial sectional view of the archery bow of the first preferred embodiment of my present invention, taken on viewing plane 6—6 of FIG. 5.

As may be seen by comparison of FIGS. 5 and 6, joint 30 is comprised of a wing member 72 and two reinforcing plates 74, 76.

As particularly seen in FIG. 6, the lower end of upper limb 26 is captive between reenforcing plates 74, 76, and is clamped therebetween by means of set screws 78, 80 which pass through clearance holes in reenforcing plates 74, 76 and in the lower end of upper limb 26, and are then received in tapped bores 82, 84 in wing member 72, and engaged with the internal threads thereof.

Thus, as seen in FIG. 6, wing 72 is rigidly affixed to the lower end of upper inner limb 26, in perpendicular relationship thereto.

Figure 7:
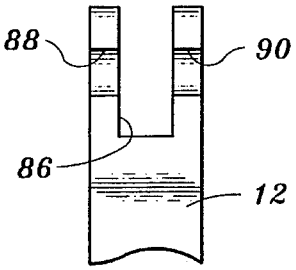
FIG. 7 is a partial view of the archery bow of the first preferred embodiment of my present invention, showing the upper end of the riser thereof, taken on viewing plane 7—7 of FIG. 5.

Referring now to FIG. 7, there is shown the upper end of riser 12.

As seen in FIG. 7, an open slot 86 passes through the end of riser 12, and a pair of aligned slots 88, 90 pass through the separate end portions of riser 12 defined by slot 86.

Referring again to FIG. 5, and comparing it with FIG. 14, it will be seen that ear 72 is pivotably mounted on riser 12 by means of a pivot screw 92 which passes through a clearance hole 89 in the upper end of riser 12 and then is engaged with the threads of a tapped hole 91 in wing 72. Lower limb 28 is correspondingly mounted on riser 12 by means of a pivot screw which passes through a clearance hole 91' in the lower end of riser 12 and then is engaged with the threads of a tapped hole 91' in wing 73.

Figure 14A:
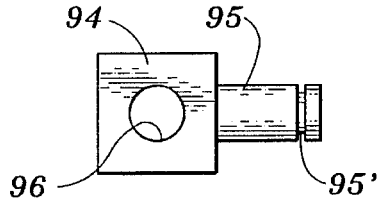
FIG. 14A is a view of a part of the assembly shown in FIG. 14.

As seen in FIGS. 14 and 14A, pivot block 94 is pivotably mounted on wing 72. Pivot block 94 (FIG. 14A) is provided with an integral cylindrical stud 95 having a groove 95'. Stud 95 is passed through a close-fitting hole in wing 72 and is maintained in that hole by a snap ring 97, coacting with groove 95'. Pivot block 99 is pivotably attached to wing 73, its stud 95" passing through a clearance hole 101 in wing 73, and being maintained in hole 101 by means of a snap ring 97'.

As seen in FIG. 14A, an unthreaded clearance hole 96 passes completely through pivot block 94.

The shank of a T-bolt 98 (FIGS. 5 and 14) passes through slot 86, as seen in FIG. 5, and the two ends of its head 98' are received in slots 88, 90, respectively (FIGS. 5 and 14).

As also seen in FIG. 5, the shank of T-bolt 98 then passes through the clearance bore 96 in pivot block 94, and a fibre lock nut 100 is threaded onto the shank of T-bolt 98 until it comes in contact with the face of pivot block 94 remote from riser 12.

Thus, it will be seen from FIGS. 5 and 14 that the draw length of bow 10 can be adjusted by repositioning locking nut 100 on the shank of T-bolt 98 and repositioning corresponding locking nut 100' in lower joint 32, when, as seen in FIG. 2, tension in cables 48 and 50 biases the outer ends of limbs 26 and 28 toward each other.

Under such bias, the angle between limb 26 and riser 12 may be adjusted by manipulating, with a suitable tool, fibre lock nut 100.

Referring now to FIGS. 8, 10, 11 and 13, there is shown upper outer limb assembly 38 and the other parts of bow 10 immediately associated therewith.

Figure 13:
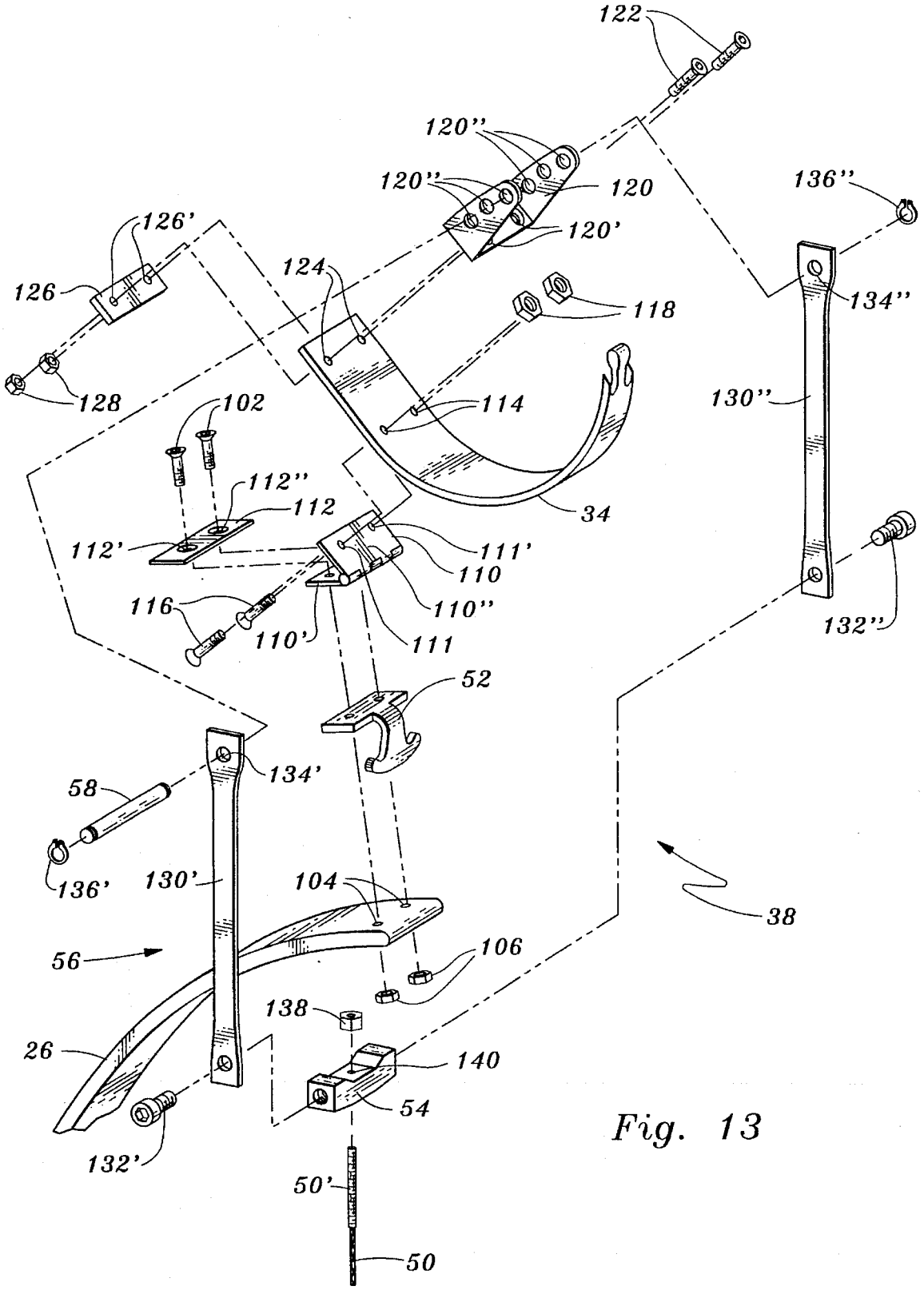
FIG. 13 is an exploded partial perspective view of the archery bow of the first preferred embodiment of my present invention, showing the upper end thereof.

As shown in FIG. 13, cable anchor 52 is mounted on the outer end of limb 26 by means of bolts 102 which pass through suitable holes 104 in the outer end of limb 26. Nuts 106 cooperate with bolts 102 to secure cable anchor 52 to the outer end of limb 26.

As further seen in FIG. 13, bolts 102 also pass through the holes in the lower leaf 110' of hinge 110, and also through the holes 112', 112" in part 112, which will sometimes be called a "stop" herein, for reasons which will become apparent hereinafter.

Thus, it will be understood by those having ordinary skill in the art, informed by the present disclosure, that stop 112, hinge 110 and cable anchor 52 are all bolted to the outer end of limb 26 by means of bolts 102 and associated nuts 106.

Figure 9:
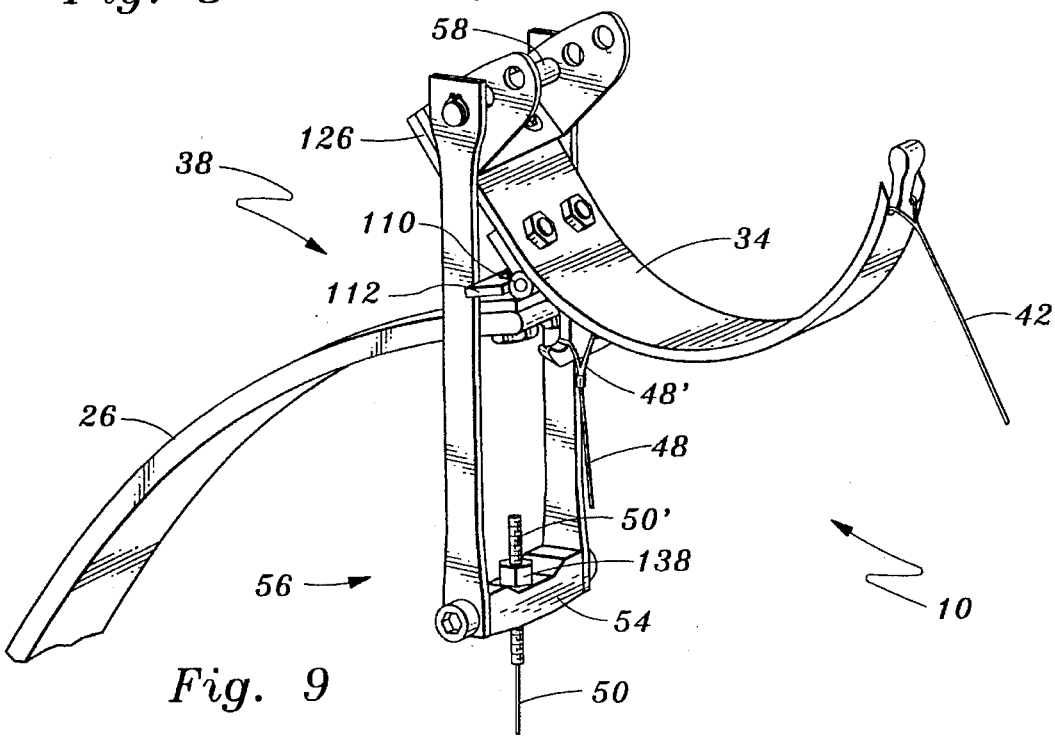
FIG. 9 is a partial perspective view of the archery bow of the first preferred embodiment of my present invention, adjusted for immediate use, with the bowstring fully drawn, showing the upper end of the left-hand side thereof.

As may be seen by comparison of FIG. 8 and FIG. 9, stop 112 contacts sidebars 130', 130" of yoke 56 when bow 10 is correctly adjusted and bowstring 42 is fully drawn to what is called herein the "standard draw length".

As seen in FIG. 4, recurve pivot joint 40 is substantially the same as recurve pivot joint 32, but inverted in use, and thus recurve pivot joint 40 includes a stop 112-3 which corresponds to stop 112 and functions in the same way. Thus, it will be seen that the standard draw condition exists when each stop 112, 112-3 is in contact with a pair of yoke sidebars 130', 130" or 130-3, 130-4.

As further seen in FIG. 13, recurve lever 34 is provided with two suitably located holes 114, 114', which are suitably spaced and located for coaction with the holes 111, 111' in upper leaf 110" of hinge 110.

As also seen in FIG. 13, a pair of bolts 116 pass through the respective holes 111, 111' in upper leaf 110" of hinge 110, and then pass through holes 114, 114' in recurve lever 34 and are engaged with nuts 118.

Figure 10:
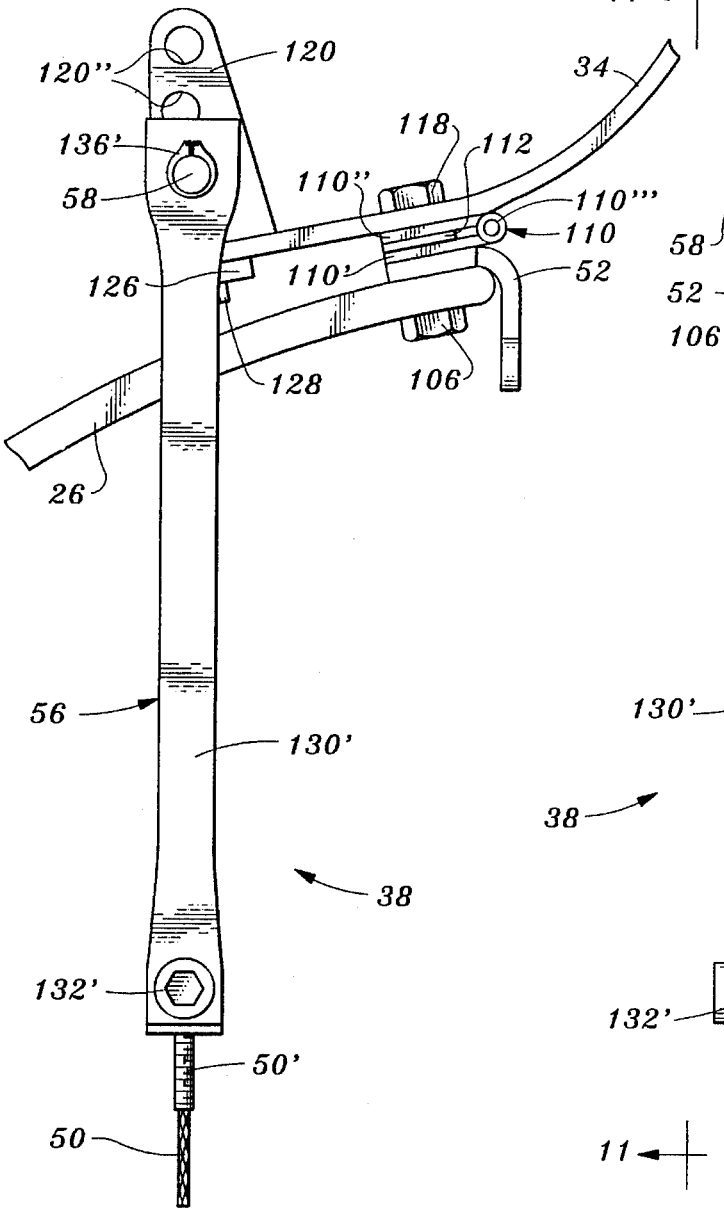
FIG. 10 is a partial elevational view of the archery bow of the first preferred embodiment of my present invention, showing the upper left-hand side thereof.
Figure 11:
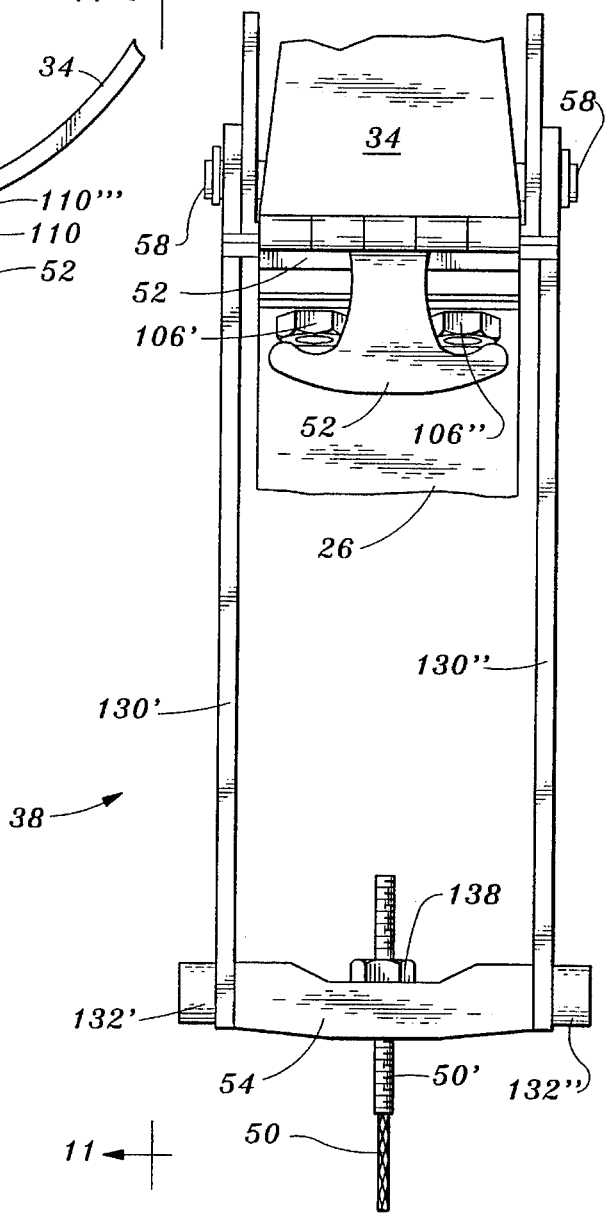
FIG. 11 is a partial elevational view of the archery bow of the first preferred embodiment of my present invention, taken on viewing plane 11—11 of FIG. 10.

As best seen in FIG. 10, hinge 110 is of such configuration that when leaves 110' and 110" are mutually parallel there is enough space therebetween to contain stop 112.

Thus, recurve lever 34 is attached directly to upper leaf 110" of hinge 110 by means of bolts 116 and cooperating nuts 118.

As yet further seen in FIG. 13, a bracket 120 is affixed to recurve lever 34 adjacent the inner end thereof by means of screws 122 which pass through holes 120' in the base of bracket 120, and thence through holes 124 at the inner end of recurve lever 34 and the holes 126' in reenforcing plate 126 and are then engaged by associated nuts 128.

As also seen in FIG. 13, the sides or ears of bracket 120 are provided with three pairs of aligned holes 120"'.

Referring again to FIG. 8, it will be seen that a yoke 56 is associated with bracket 120.

Comparing FIGS. 8 and 13, it will be seen that yoke 56 is comprised of a crossbar 54, a pivot pin 58, two sidebars 130', 130", and a pair of machine screws 132', 132".

As may be seen by comparison of FIGS. 8 and 13, yoke 56 is partially assembled by affixing the lower ends of side bars 130', 130" to the opposite ends of crossbar 54 by means of machine screws 132', 132".

This subassembly is then positioned below the upper end of limb 26 and moved upwardly until the holes 134', 134" in the upper ends of sidebars 130', 130" are aligned with a selected pair of the holes 120" in bracket 120.

Upper crossbar or pivot pin 58 is then passed through the aligned holes 134', 120", 120", 134", and snap rings 136', 136" are attached to the opposite ends of pivot pin 58 in the well known manner.

Thus, as described immediately above, upper recurve pivot assembly 38 is assembled upon the outer end of upper limb 26.

Since, as may be seen from FIGS. 1 and 2, lower recurve pivot assembly 40 is substantially identical to upper recurve pivot assembly 38, lower recurve pivot assembly 40 may be assembled on the outer end of lower limb 28 by those having ordinary skill in the art,informed by the immediately preceding description of the assembly of upper recurve pivot assembly 38 on upper limb 26.

As further seen in FIG. 13, the upper end of cable 50 will subsequently be attached to crossbar 54 of yoke 56 by first passing the threaded ferrule 50' attached to the upper end of cable 50 through the central clearance hole 140 in crossbar 54 and then threading fibre lock nut 138 onto ferrule 50'.

The lower end of cable 48 will similarly be attached to the crossbar 54' of yoke 60 by passing the threaded ferrule 48' attached to the lower end of cable 48 through the central hole 140' in the crossbar 54' of yoke 60 and then threadedly engaging a fibre lock nut 138' therewith.

The mode of attaching the ends of bow string 42 to the respective recurve levers 34, 36 will be evident to those having ordinary skill in the art, informed by the present disclosure, and particularly from FIG. 8 and the above text related thereto.

Figure 15:
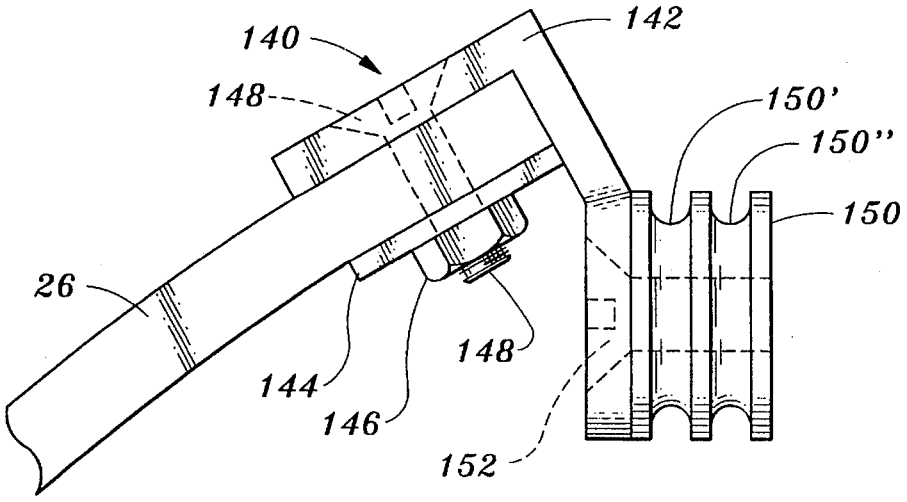
FIGS. 15 and 15A show the cable anchor of the second preferred embodiment of my present invention.
Figure 15A:
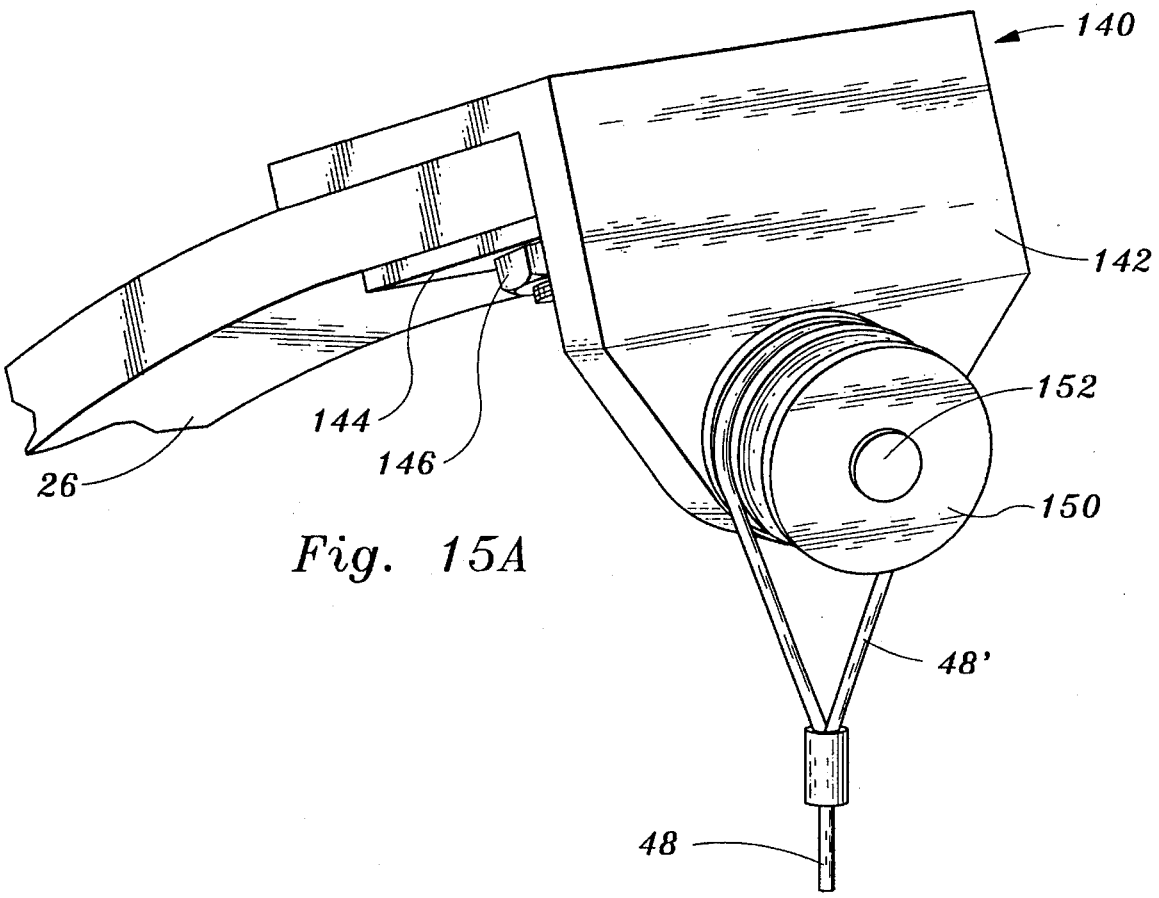

Referring now to FIGS. 15 and 15A, there is shown an alternative form of cable anchor 140, which may be attached to the end of upper limb 26 as a substitute for cable anchor 52 (FIG. 13).

As will be evident to those having ordinary skill in the art, informed by the present disclosure, the substitution of cable anchor 140 for cable anchor 52, at the upper (outer) end of limb 26, should be accompanied by the substitution of a substantially identical cable anchor 160 (not shown) at the lower (outer) end of limb 28.

As seen in FIG. 15, cable anchor 140 is comprised of a bracket 142 which is bolted to the outer end of upper limb 26.

As also best seen in FIG. 15, a reinforcing plate 144 is located below the upper end of upper limb 26, and a nut 146 bears against the outer surface of reenforcing plate 144.

A bolt 148 which passes through the part of bracket 142 overlying the outer end of upper limb 26 and passes through the upper end of limb 26 via a clearance hole (not shown), also passes through a suitable clearance hole in the reinforcing plate 144, and then is threadedly engaged with nut 146.

As seen in FIGS. 15 and 15A a generally circular cable receiver 150 having grooves 150'and 150" extending circumferentially therearound is fastened to the outer end of bracket 142 by means of a screw 152 (FIG. 15) which passes through a suitable clearance hole in the lower end of bracket 142 and is engaged with the threads of a tapped bore which passes axially through cable receiver 150.

As best seen in FIG. 15A, the loop 48' at the end of cable 48 is passed over cable receiver 150 and then seated in groove 150'.

As will be understood by those having ordinary skill in the art, informed by the present disclosure, a similar cable anchor 160 (not shown) is secured to the lower (outer) end of lower inner limb 28.

The loop 50' at the lower end of cable 50 is interengaged with the inner groove of the cable receiver portion of the lower cable anchor 160.

As will now be evident to those having ordinary skill in the art, informed by the present disclosure, cable anchors 140, 160, being provided with two grooves, provide anchorage not only for cables 48, 50, but also provide anchorage for a bow binder, whereby to conveniently string or unstring the bow of the invention which is equipped with cable anchors of the kind shown in FIGS. 15 and 15A and described in connection therewith.

Bow Adjustment

As will now be evident to those having ordinary skill in the art, informed by the present disclosure, the bow of the present invention is provided with several adjusting means whereby the major parameters of the bow of the invention may be independently adjusted.

Draw Force Adjustment. The draw force or pulling weight of bow 10 may be adjusted by rotating both fiber lock nut 100 and fiber lock nut 100' to the same extent, i.e., through the same total angle.

Draw Length Adjustment. The draw length of a particular bow embodying the present invention may be adjusted in two stages, viz., a rough adjustment stage and a fine adjustment stage.

The rough adjustment of the draw length of a particular bow embodying the present invention is made by moving pivot bar 58 (FIGS. 8 and 13) from one pair of aligned holes 120" to another pair of aligned holes 120". By way of example, the outer (upper) pair of aligned holes 120" in the first preferred embodiment of my present invention (FIG. 8) corresponds to a rough draw length of 28 inches; the middle pair of holes 120" corresponds to a rough draw length of 30 inches; and the lower aligned pair of holes 120" corresponds to a rough draw length of 32 inches.

Fine or intermediate draw length adjustments may be made by rotating lock nut 100 in joint 30 and corresponding lock nut 100' in joint 32 by the same amount.

Balance Adjustment. A bow embodying the present invention may be adjusted for balance, i.e., axial symmetry about the axis of an arrow correctly located in the properly fully drawn bow, by the rotating one at a time of lock nuts 138, 138' until, when the bow is fully drawn to its "standard draw position", stop 112 contacts its associated side bars 130', 130" and, at the same time, the corresponding stop 112-1 of lower pivot assembly 40 (FIG. 4) contacts its associated side bars 130-3, 130-4, as also shown in FIG. 4.

According to the present invention, cable deflector rod 62 (FIG. 14) is mounted in a tapped hole in the rearward edge of riser 12.

According to the present invention, stops 112, 112-1 (FIG. 4) provide a distinctive proprioceptive signal (or "feel") to indicate when bow 10 is drawn to standard draw length. In a particular embodiment the particular draw force or pull weight just before standard draw is about 25 pounds, and the draw force to draw, say, one-sixteenth of one inch beyond standard draw is several times 25 pounds or more.

According to the present invention bow 10 includes four working elements 26, 28, 34, 36 instead of the conventional two working elements (compare undrawn bow elements (solid lines) with corresponding drawn bow elements (dashed lines) in FIGS. 2).

It will thus be seen that the objects set forth above, among those made apparent from the preceding description, are efficiently attained, and since certain changes may be made in the above constructions and the methods carried out thereby without departing from the scope of my present invention, it is intended that all matter contained in the above description or shown in the accompanying drawings shall be interpreted as illustrative only, and not in a limiting sense.

It is also to be understood that the following claims are intended to cover all of the generic and specific features of the invention hereindescribed, and all statements of the scope of the invention which, as a matter of language, might be said to fall therebetween.

What is claimed is:

1. An archery bow, comprising:

an elongated body;

first and second inner limbs extending outwardly from the opposite ends of said body;

first and second pivot means mounted on the portions of said inner limbs remote from said body;

first and second outer limbs mounted on said first and second pivot means, each of said pivot means being located between an inner portion and an outer portion of its associated outer limb;

first and second coupling cable assemblies each of which extends directly from the said inner portion of one of said outer limbs to the outer portion of the opposite one of said inner limbs; and a bowstring extending between said outer portions of said outer limbs.

2. An archery bow as claimed in claim 1 in which each outer portion of one of said outer limbs is a recurve portion of said archery bow which is contacted by an outer portion of said bowstring when said bowstring is undrawn.

3. An archery bow as claimed in claim 2 in which each of said cable assemblies includes a yoke which embraces the outer portion of one of said inner limbs and is pivotably affixed to the inner portion of the adjacent one of said outer limbs.

4. An archery bow as claimed in claim 3 in which each of said cable assemblies includes cable length adjusting means for adjusting the length of the cable extending between the yoke thereof and the outer portion of the opposite one of said inner limbs.

5. An archery bow as claimed in claim 1 in which each of said cable assemblies includes a yoke which embraces the outer portion of one of said inner limbs and is pivotably affixed to the inner portion of the adjacent one of said outer limbs.

6. An archery bow as claimed in claim 5, further comprising adjusting means for adjusting the positions of said yokes with respect to their associated outer limbs when said bowstring is undrawn.

7. An archery bow as claimed in claim 1 in which each of said cable assemblies includes cable length adjusting means for adjusting the length of the cable extending between the yoke thereof and the outer portion of the opposite one of said inner limbs.

8. An archery bow as claimed in claim 1, further comprising adjusting means for adjusting the angles between said body and said inner limbs.

9. An archery bow as claimed in claim 1 in which said outer limbs are less resiliently deformable than said inner limbs.

* * * * *